US009399532B2

(12) United States Patent
Noe et al.

(10) Patent No.: US 9,399,532 B2
(45) Date of Patent: Jul. 26, 2016

(54) SYSTEM FOR FILLING PHARMACEUTICAL PRODUCTS INTO BOTTLE-SHAPED CONTAINERS

(75) Inventors: Joachim Noe, Ehingen (DE); Michael Kronawitter, Beimerstetten (DE); Ralf Heim, Laupheim (DE); Rita Hagel, Laupheim (DE); Rolf Armbruster, Neu-Ulm (DE)

(73) Assignee: Uhlmann Pac-Systeme GmbH & Co. KG (DE)

( * ) Notice: Subject to any disclaimer, the term of this patent is extended or adjusted under 35 U.S.C. 154(b) by 1381 days.

(21) Appl. No.: 12/134,641

(22) Filed: Jun. 6, 2008

(65) Prior Publication Data

US 2008/0307750 A1 Dec. 18, 2008

(30) Foreign Application Priority Data

Jun. 18, 2007 (EP) ..... 07011867

(51) Int. Cl.

| | |
|---|---|
| ***B65B 65/02*** | (2006.01) |
| ***B65B 65/00*** | (2006.01) |
| ***B65B 5/10*** | (2006.01) |
| ***B65B 59/04*** | (2006.01) |

(52) U.S. Cl.

CPC ..... *B65B 65/003* (2013.01); *B65B 5/103* (2013.01); *B65B 59/04* (2013.01); *B65B 65/02* (2013.01)

(58) Field of Classification Search

CPC ..... B65B 65/00; B65B 65/02
USPC ..... 53/410, 485, 130.1, 267, 268, 281, 282, 53/295

See application file for complete search history.

(56) References Cited

U.S. PATENT DOCUMENTS

| | | | | |
|---|---|---|---|---|
| 2,550,156 | A | 4/1951 | Lyon | |
| 5,566,527 | A * | 10/1996 | Drewitz | 53/295 |
| 5,713,180 | A * | 2/1998 | Lewis | 53/253 |
| 5,809,738 | A * | 9/1998 | Stephens et al. | 53/154 |
| 6,523,328 | B1 * | 2/2003 | De Cardenas et al. | 53/399 |
| 6,755,223 | B1 | 6/2004 | Trebbi et al. | |

FOREIGN PATENT DOCUMENTS

| | | |
|---|---|---|
| DE | 35 27 742 | 2/1987 |
| DE | 43 20 477 | 12/1994 |
| DE | 103 22 556 | 4/2004 |
| DE | 103 60 082 | 7/2005 |
| FR | 2 519 614 | 7/1983 |

OTHER PUBLICATIONS

Optima Packaging Group article. 12 pages. Date: 2003.

* cited by examiner

*Primary Examiner* — Nathaniel Chukwurah
(74) *Attorney, Agent, or Firm* — Jansson Munger McKinley & Kirby Ltd.

(57) ABSTRACT

The invention pertains to a system for filling bottle-like containers with tablets, which comprises various devices for specific processes, wherein most of the devices have a transport mechanism for positively guiding the movement of each container by itself in a continuous manner, whereas at least the device for dosing the pharmaceutical products and for introducing the pharmaceutical products into the containers has a transport mechanism for positively guiding the movement of each container by itself in a clocked manner in certain sections. The transport mechanisms of the devices are connected to each other in series, which ensures the positive guidance of each individual container by itself through the entire system.

11 Claims, 5 Drawing Sheets

SYSTEM FOR FILLING PHARMACEUTICAL PRODUCTS INTO BOTTLE-SHAPED CONTAINERS

CROSS REFERENCE TO RELATED APPLICATION

This application claims priority based on European patent application EP 07 011 867.4, filed Jun. 18, 2007.

FIELD OF THE INVENTION

The invention pertains to systems for filling bottle-like or can-like containers with pharmaceutical products.

DESCRIPTION OF THE PRIOR ART

Systems of this type have been used for many years to fill bottle-like containers with relatively large numbers of tablets, so that a patient will have a sufficient number of tablets available for several weeks of daily administration, for example. These types of systems for filling bottle-like containers with tablets usually comprise a device for introducing a desiccant into each container, a device for counting and introducing the tablets into the containers, a device for introducing a wad of cotton into each container, a device for placing a cap on each container, a device for sealing the caps onto the containers, and a device for rejecting specific containers after a quality inspection. The individual devices are arranged in a line as individual, stand-alone units, wherein the containers are conveyed between the individual units by means of conventional conveyor belts.

The disadvantage of systems of this type is in particular that the individual devices and conveyor belts must be adjusted precisely with respect to each other, which demands a great deal of effort. In addition, containers which have been found to be defective must be rejected after each quality control inspection station, because it is very complicated to keep track of all of the products as they pass through the various stations of the processing line.

SUMMARY OF THE INVENTION

It is therefore an object of the present invention to provide a system for filling bottle-like containers with pharmaceutical products, in which it is possible to keep precise track of each individual container within the system at all times, which is suitable for rejecting all of the bad containers at a single location in the process chain, and in which the transport mechanisms can be installed and maintained with particular ease.

According to an aspect of the invention, the system for filling bottle-like or can-like containers with pharmaceutical products includes a device for dosing the pharmaceutical products and for introducing the pharmaceutical products into the containers. In addition, it includes at least three of the following devices: a device for feeding the containers into the system; a device for introducing a desiccant into each container; a device for introducing a wad of cotton into each container; a device for installing a cap on each container; a device for sealing the caps onto the containers; and a device for rejecting certain containers and for discharging the other containers from the system.

A plurality of the devices comprise a transport mechanism for positively guiding the movement of each container by itself in a continuous manner, whereas at least the device for dosing the pharmaceutical products and for introducing the pharmaceutical products into the containers comprises a transport mechanism for positively guiding the movement of each container by itself in a clocked manner in certain sections. The transport mechanisms of the devices are connected to each other in series, which ensures the positive guidance of each individual container by itself through the entire system.

As a result, it becomes possible to transport the containers in such a way that they remain trackable at all times, even if different forms of movement are involved. This increases the reliability of the filling process and also contributes to the simplification of the design and to the reduction of the amount of installation and adjusting work required.

An especially simple way to obtain a continuous, positively guided movement of the individual containers is to provide each transport mechanism with at least one screw conveyor.

To prevent the containers from escaping in the direction perpendicular to their direction of movement, each transport mechanism preferably has a guide plate for the continuous, positively-guided movement of each container by itself, this plate being arranged parallel to the screw conveyor.

It is especially advantageous for the transport mechanism for positively guiding the movement of each container by itself in a clocked manner to be designed so that the travel of the containers around the periphery of a sliding carriage is combined in a controlled manner with a translational movement of the sliding carriage. As a result, a seamless transition from a continuous movement to a clocked movement and back again to a continuous movement becomes possible.

A simple design is obtained by using an endless traveling belt, which is equipped with carrier elements and which is deflected around belt pulleys mounted on the sliding carriage, as the transport mechanism for positively guiding the movement of the individual containers in a clocked manner in certain sections.

To achieve a further simplification of the installation or replacement of the devices, each device is designed as a modular unit with its own housing, wherein the housings of all the modular units are connected to each other in series, so that the system is designed as an integral system.

The need to make special adjustments to the transport mechanisms at the transitions between the modular units can be avoided in that, in a plurality of the devices, a first screw conveyor projects by a predetermined amount from one side from the housing in question and extends into the adjacent housing, and that, in the adjacent housing, a second screw conveyor is arranged parallel to and a predetermined distance away from the first screw conveyor, so that the two screw conveyors form a means for transferring the containers from one modular unit to the next.

The adjustment of the positioning between two adjacent housings is accomplished by connecting them to each other accurately, preferably by means of alignment pins.

In addition to the space which is saved as a result of the modular, interconnected design, the integral system is preferably designed so that it is essentially sealed off from the outside, as a result of which the danger of contamination is reduced and the system can be operated, if desired, in a clean room of one of the lower classes.

The housings are divided in a standardized manner. Each has a flat shelf, on which the transport mechanisms for the containers are mounted and under which the drive and adjusting units as well as cables for the various devices, for example, are installed.

BRIEF DESCRIPTION OF THE DRAWINGS

Additional details, features, and advantages of the present invention can be derived from the following description, which refers to the drawings.

DETAILED DESCRIPTION OF THE INVENTION

Figure 1:
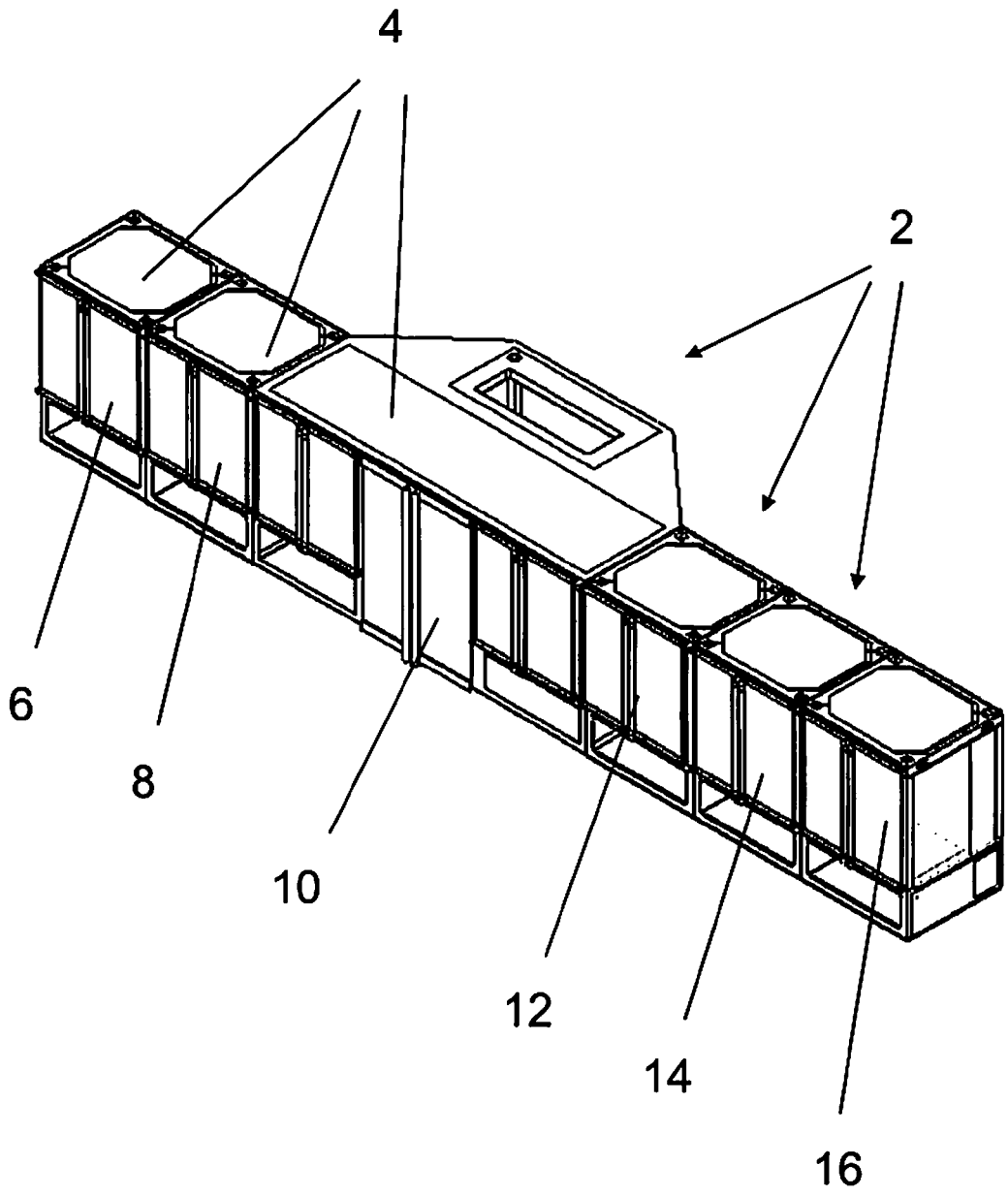
FIG. 1 is a schematic side view of a system for filling bottle-like containers with pharmaceutical products.

FIG. 1 shows an embodiment of a system for filling bottle-like or can-like containers with pharmaceutical products. The system has a modular design, wherein the individual process steps are integrated into various standard modules, which together form the integral system. It is also possible, in principle, however, to use modules which are arranged a certain distance apart.

Each of the various modular units 2 in this example has its own housing 4, which normally corresponds to a standard housing with precisely defined dimensions in the area where it connects to the adjacent housing. Even in the case of modular units 2 which are larger in the direction transversely to the transport direction, the dimensions in the areas where the housings interconnect are always kept the same.

In the present example according to FIG. 1, the individual modular units 2 comprise a device 6 for feeding the containers 5 into the system, a device 8 for introducing a desiccant into each container 5, a device 10 for counting tablets and for introducing the tablets into containers 5, a device 12 for placing a cap on each container 5, a device 14 for sealing the caps onto containers 5, and a device 16 for rejecting certain containers 5 and for discharging the other containers 5 from the system.

Supplemental devices can also be integrated into the filling system, such as a device (not shown here) for introducing a cotton wad into each container 5. Certain devices in the chain can also be left out.

Even though modular units 2 can be combined in nearly any sequence to form an integral system, there are still sequences which are logical in terms of the various steps which must be performed in the filling system and which cannot be changed. For example, it is impossible not to put the device 12 for placing a cap on each container 5 after device 10 for counting the tablets and for introducing the tablets into containers 5.

The device 6 for feeding containers 5 into the system has the purpose of accepting containers 5 into the transport equipment of the system, which will be described later in detail, and of separating the containers so that each one is carried along by itself. The device 8 for introducing a desiccant into each container 5 adds a known desiccant to bottle-like containers 5 to reduce the moisture content in container 5 to a defined level or to keep the moisture content at that level after the container has been sealed. The device 10 for counting tablets and for introducing the tablets into containers 5 can be designed in various ways. In all of known devices 10, the tablets are counted as they come from a supply source and then are introduced into containers 5. The important point here is that the correct quantity of tablets must arrive in each container 5.

By means of device 12 for placing a cap on each container 5, the containers are each provided with a cap, preferably under controlled torque. Each cap has already been provided with an aluminum seal. In the device 14 for sealing the caps onto containers 5, the aluminum seal is heated by induction and fused to container 5. The device 16 for rejecting certain containers 5 and for discharging the rest of containers 5 from the system serves, finally, to convey containers 5 onto a following conveyor belt. In addition, containers 5 classified as unsuitable can be rejected, or containers 5 can be removed for process control. It is necessary in this case to provide certain sensors or cameras in the system chain for monitoring tasks.

Figure 2:
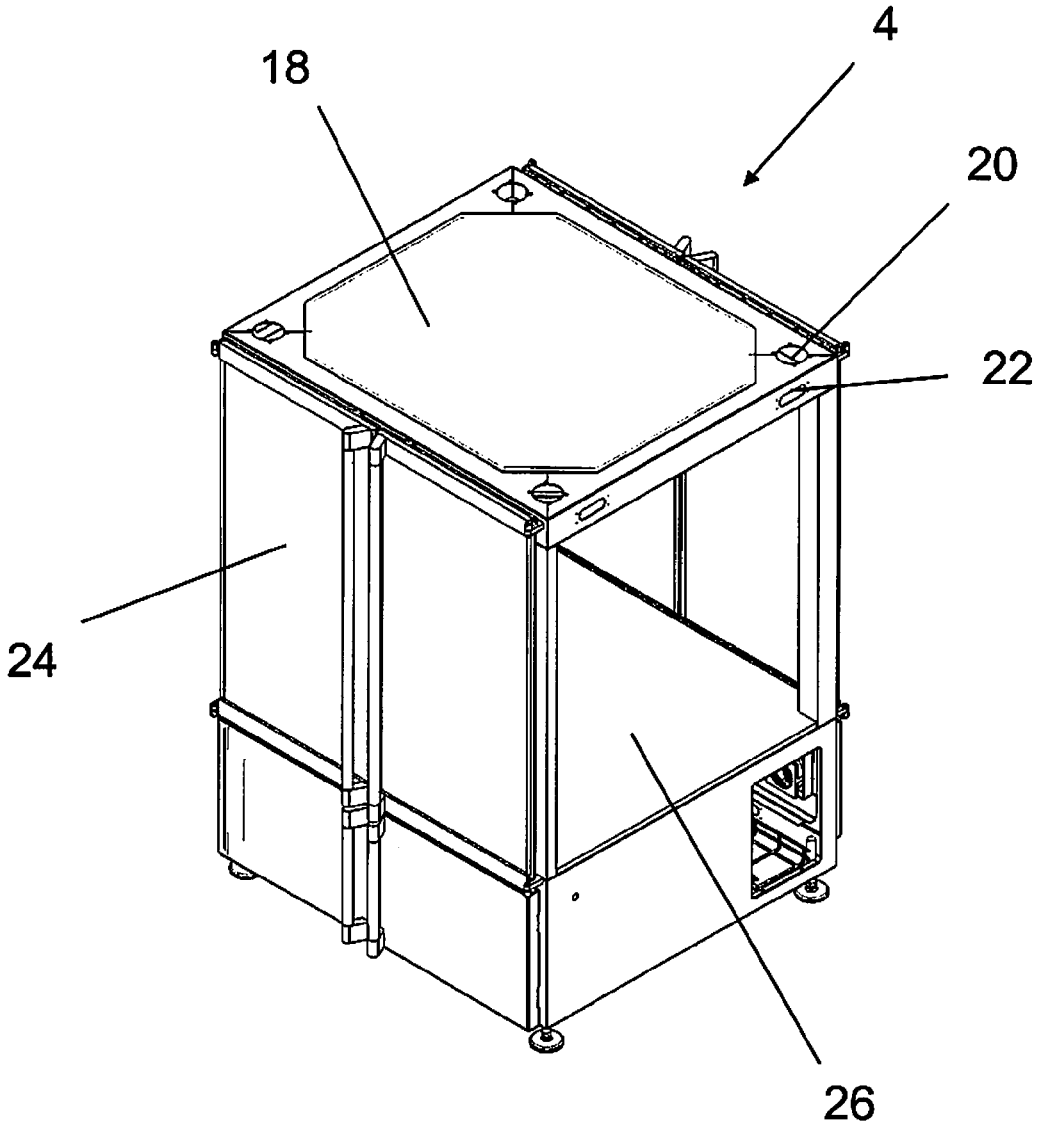
FIG. 2 is a perspective view of an example of a housing of a modular unit of the system according to FIG. 1.

FIG. 2 shows a housing 4 of a standardized modular unit 2 without internal fittings as an example of a uniform design. The housing 4 has a roof 18, which is suitable for the integration of various top-mounted components. For this purpose, sockets 20, for example, are provided in the roof for various top-mounted components and attachments, e.g., dehumidifiers, certain types of lighting devices, or suction devices. In addition, a central area of the roof 18 is designed to be removable. In the vertical side areas adjacent to roof 18, pass-throughs 22 are provided, through which cables and hoses can be guided to the neighboring module. At least on the front and the rear of the modular unit 2, safety doors 24 or safety windows are provided. These are preferably designed so that they can be exchanged as desired, to allow flexible access to certain areas. At least in certain areas, the safety doors 24 are preferably transparent. It is advisable to provide similar safety windows or safety doors 24 in the sides, at least at some of the transitions between two modular units 2 and especially at the beginning and at the end of the system. In a design of this type it is possible to transport the tablets inside a protected area from the counting operation to the sealing of containers 5. It is also possible to seal off especially sensitive points of the system from the outside by applying various pressure levels in adjacent modular units 2. Thus the system can even be operated in a clean room of one of the lower classes.

At about one-third of the height of housing 4, a flat shelf 26 is arranged, which divides the interior of housing 4 into an upper area and a lower area. The upper area usually holds a transport mechanism 28, to be described in greater detail below, for containers 5 and also other active components of devices 6, 8, 10 12, 14, 16 in question. Under the flat shelf 26, the mechanical components and the cabling for the devices, for example, will be installed, wherein, again, various attachment points for the corresponding interior fittings are provided.

Modular units 2 can normally be set up in a row without special adjustments. Alignment pins, for example, are used to establish the connections.

Figure 3:
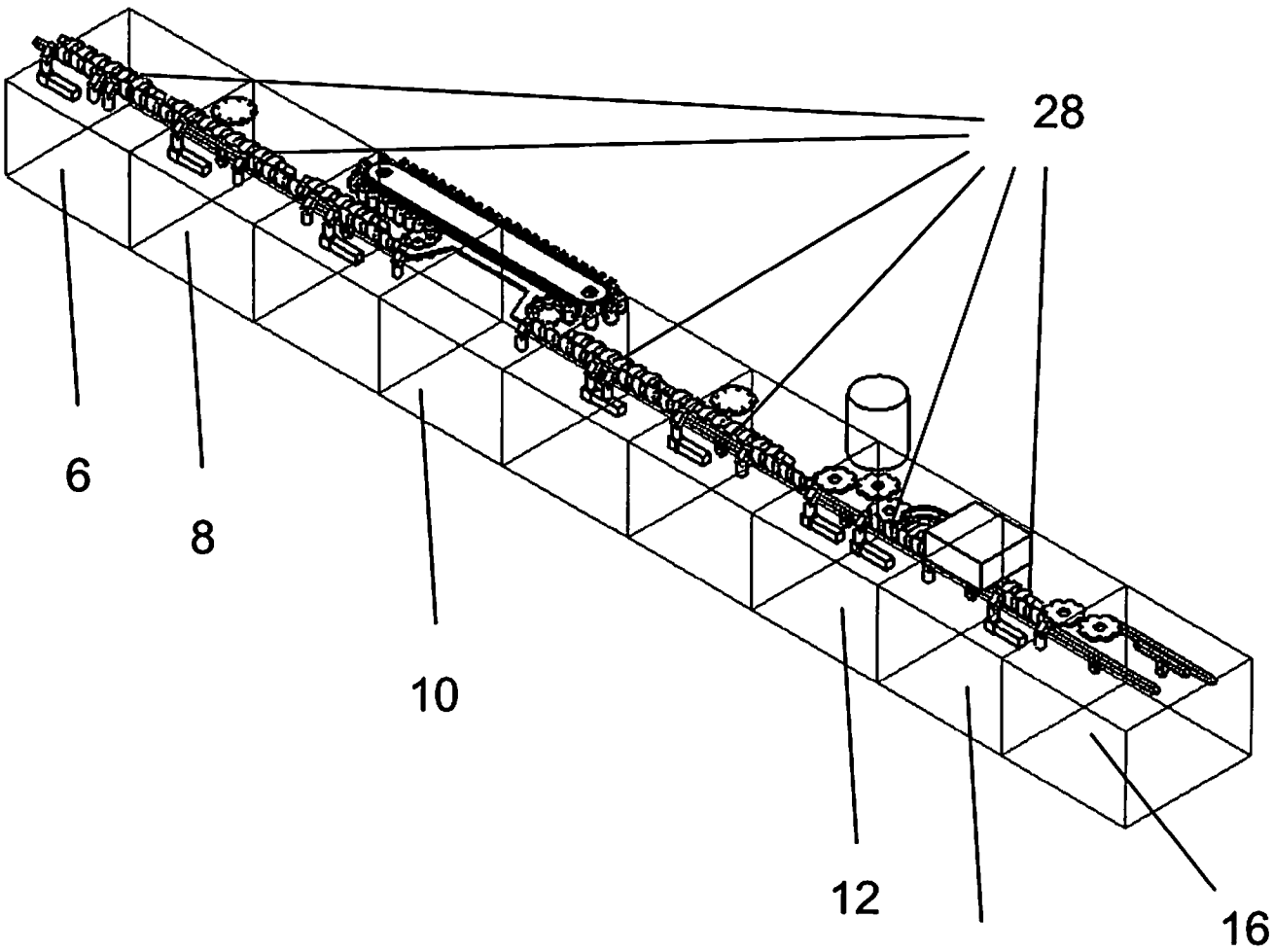
FIG. 3 is a schematic perspective view of an embodiment of the inventive transport mechanism for the containers in the system of FIG. 1.

FIG. 3 shows the overall inventive transport chain of the system illustrated in FIG. 1, wherein each individual device 6, 8, 10, 12, 14, 16 comprises its own transport mechanism 28, in which containers 5, which are supplied to the system, are carried along individually and positively. Especially simple types of transport mechanisms 28 are screw conveyors 30, 32, which will be described in greater detail below on the basis of FIG. 4. Other transport mechanisms 28 such as belts with carrier elements are also conceivable. It should be emphasized in particular that each individual container 5 is positively guided through the entire system, and thus it is possible to track a product through each of modular units 2. As a result, even if individual containers 5 are subjected to several quality inspections, for example, it is still possible to discharge all of rejected containers 5 at the end of the system, for example, i.e., in device 16. Even in cases where a container 5 is removed actively from the row, the resulting gap can also be detected and allowances can be made for it in the rejection process.

Whereas containers 5 are basically transported continuously in most of modular units 2, a clocked form of movement is used to some extent in the area of device 10 for counting and introducing the tablets into containers 5 at the required speeds. Nevertheless, this transport mechanism also fits seamlessly into the transport chain, as will be described later in greater detail with reference to FIG. 5.

Figure 4:
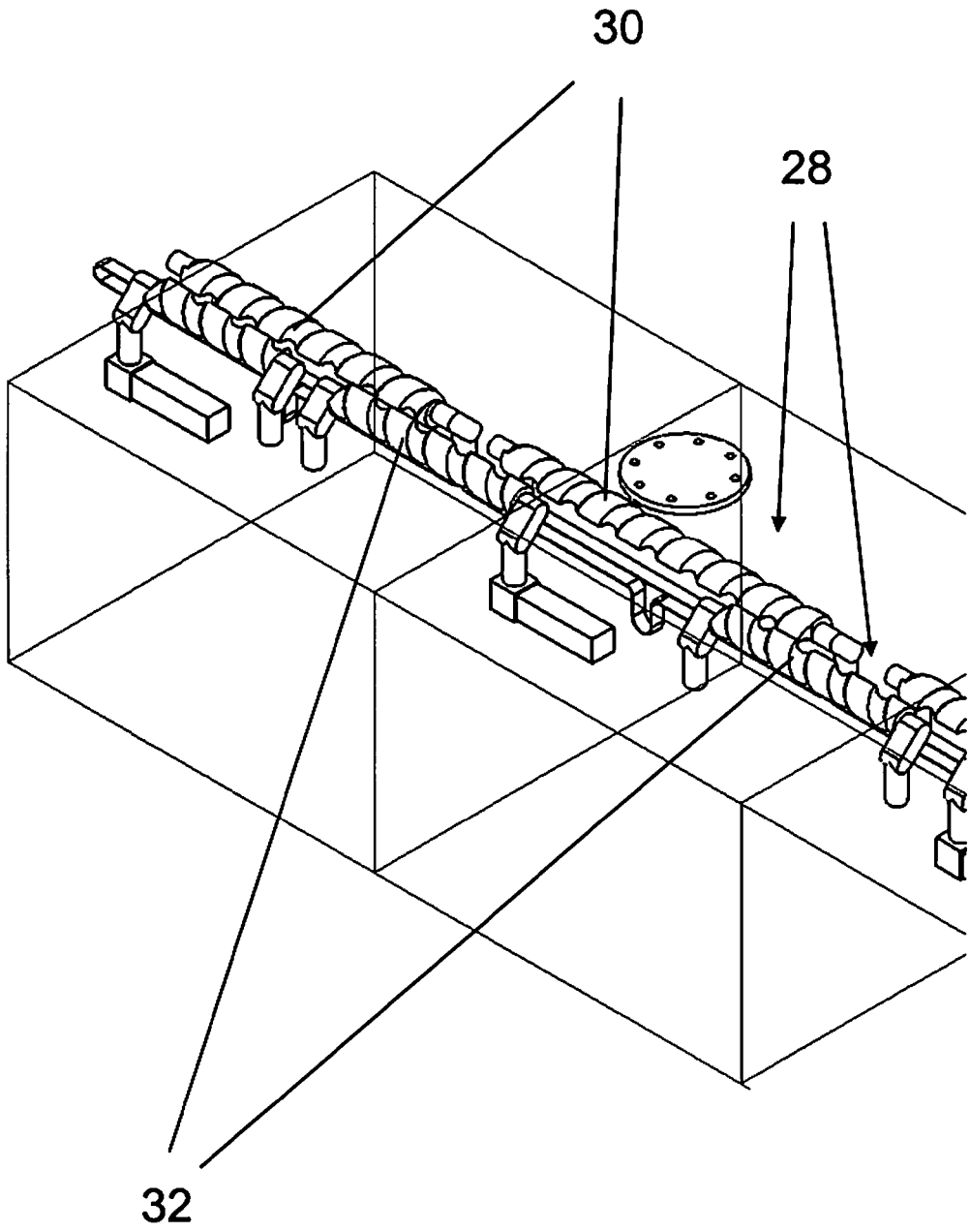
FIG. 4 is an enlarged, schematic perspective view of part of FIG. 3, from which the transition between the transport mechanisms of two individual modular units can be seen.

To guarantee the seamless transition between the transport mechanisms 28 of adjacent modular units 2, the design shown in FIG. 4 by way of example is suitable. Here a first screw conveyor 30 is arranged in a housing in such a way that it projects by a predetermined amount into the neighboring housing; in the present case, it projects into housing 4 to its left. In addition, a second screw conveyor 32 is installed in neighboring housing 4 parallel to, and a predetermined distance away from, the first screw conveyor 30, so that two screw conveyors 30, 32 form an especially simple means for transferring containers 5 from one modular unit 2 to the next.

The onward movement of containers 5 proceeds basically by means of the continuous movement of screw conveyors 30, 32, wherein containers 5 are held in the recesses of screw conveyors 30, 32 and are carried forward by the rotation of the screw shafts. It is important that screw conveyors 30, 32 be aligned with each other in the transfer areas and that they move in synchrony with each other. Within a modular unit 2, however, it is sufficient for container 5 to be guided by a guide plate (not shown) on the side of the container opposite screw conveyor 30, 32. The guide plate ensures that containers 5 cannot fall out of the channels in the screw conveyor 30, 32 in the direction perpendicular to the direction of movement.

By means of the arrangement shown in FIG. 4, it is guaranteed, without any further adjustment, that containers 5 are transported precisely within the transport chain from one modular unit 2 to the next, wherein they are positively guided individually at all times. Of course, various modifications to transport mechanisms 28 are also conceivable.

Figure 5:
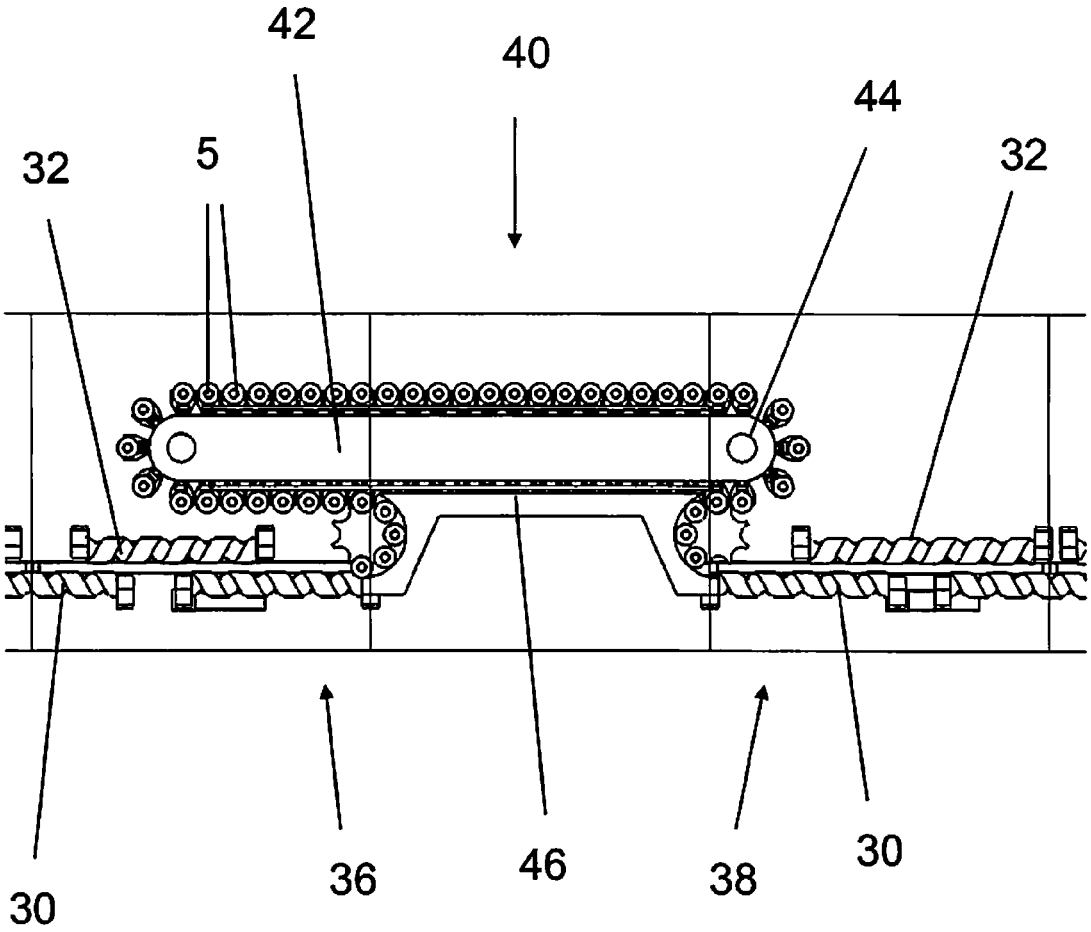
FIG. 5 is a schematic top view of the transport mechanism with a certain section which operates in a clocked manner in the device for dosing the pharmaceutical products and for introducing the pharmaceutical products into the containers.

FIG. 5 shows a detailed top view of transport mechanism 28 provided in device 10 for counting the tablets and for introducing them into containers 5. The special feature of this transport mechanism 28 is that here the continuous movement of the containers in the entrance area 36 and in the exit area 38 is converted to a clocked form of movement in an intermediate area 40 to allow the filling of containers 5. Transport mechanism 28 comprises a sliding carriage 42, which can be moved translationally in a controlled manner in the longitudinal direction of the system by a control unit.

Belt pulleys 44 or sprocket wheels, around which an endless belt 46 with carrier elements or a transport chain travels, are mounted on this sliding carriage 42. Containers 5 being brought up continuously by screw conveyors 30, 32 are turned 180° and picked up at this point by belt 46. To achieve the transition from the continuous movement to the clocked, positively guided movement, the travel of containers 5 around the sliding carriage 42 is combined in a controlled manner with the translational movement of sliding carriage 42. As a result, containers 5 can be removed continuously in entrance area 36 and simultaneously a clocked, positively guided movement of individual containers 5 in intermediate area 40 of transport mechanism 28 becomes possible. For this purpose it is important that the belt pulleys 44 and sliding carriage 42 be driven separately but in coordination with each other.

Although "tablets" are referred to in the specification, any type of solid medication is possible, such as capsules, coated tablets, etc. The system, however, is also suitable generally for the job of dosing other types of pharmaceutical products such as powder or liquid substances and for filling containers with them. "Dosing" should thus include "metering" and "counting".

Thus a system for filling bottle-like containers 5 has been created, which makes it possible to transport containers in such a way that the containers can be tracked at all times even if they are subjected to different forms of movement. The reliability of the filling process is thus increased; the overall design of the system is simplified; and the amount of assembly and adjustment work is reduced.

The invention claimed is:

1. A system for filling bottle-like or can-like containers with pharmaceutical products, the system comprising:

a device for dosing the pharmaceutical products and for introducing the pharmaceutical products into the containers;

at least three of the following devices:

a device for feeding the containers into the system;

a device for introducing a desiccant into each container;

a device for introducing a wad of cotton into each container;

a device for placing a cap on each container;

a device for sealing the caps onto the containers; and a device for rejecting certain containers and for discharging the other containers from the system;

wherein the system comprises several modular units, each having a separate housing, wherein the housings of the modular units are connected to each other in series in such a way that the system is designed as an integral system;

wherein most of said modular units comprise a transport mechanism having at least one screw conveyor for positively guiding the movement of each container by itself in a continuous manner, and the transport mechanisms of the modular units are connected to each other in series, which ensures a positive guidance of each individual container by itself through the entire system, wherein at least the device for dosing the pharmaceutical products and for introducing the pharmaceutical products into the containers comprises a transport mechanism for positively guiding the movement of each container by itself in a clocked manner in certain sections;

the connection of the transport mechanisms of adjacent modular units being achieved by a first screw conveyor arranged in an outlet portion of a first housing and by a second screw conveyor arranged in an inlet portion of a second housing, wherein a portion of the second screw conveyor is arranged parallel to and a predetermined distance away from a portion of the first screw conveyor, so that the parallel portions of the first and the second screw conveyors form a means for transferring and handing off the containers between the adjacent modular units.

2. The system according to claim 1 wherein each transport mechanism comprises a guide plate for the continuous, positively guided movement of each container by itself, the guide plate being arranged parallel to the at least one screw conveyor.

3. The system according to claim 1 wherein the transport mechanism is designed for guided movement of each container by itself in a clocked manner in certain sections and includes a sliding carriage having translational movement assisting in guided movement of each container.

4. The system according to claim 3 wherein the transport mechanism for the positively guided movement of each container by itself in a clocked manner in certain sections comprises an endless traveling belt with carrier elements and a belt pulley, which endless belt passes around the belt pulleys which is mounted on the sliding carriage.

5. The system according to claim 1 wherein two adjacent housings are connected to each other in a precisely fitting manner by means of alignment pins.

6. The system according to claim 1 wherein the integral system is designed so that it is essentially closed to the outside.

7. The system according to claim 1 wherein each housing has a flat shelf, above which the transport mechanisms for the containers are mounted, and under which drive and adjusting units and cables for the devices are installed.

8. The system according to claim 1 wherein a transport system comprising all of said transport mechanisms is designed for guided movement of each container by itself from a continuous screw movement to a clocked movement.

9. The system according to claim 8 wherein the transport system comprising all of the transport mechanisms is designed for guided movement of each container by itself from a clocked movement to a continuous screw movement.

10. The system according to claim 1 wherein the transport system comprising all of the transport mechanisms is designed for guided movement of each container by itself from a continuous screw movement to a clocked movement to a continuous screw movement.

11. A system for filling bottle-like or can-like containers with pharmaceutical products, the system comprising:

a device for dosing the pharmaceutical products and for introducing the pharmaceutical products into the containers;

at least three of the following devices:

a device for feeding the containers into the system;

a device for introducing a desiccant into each container;

a device for introducing a wad of cotton into each container;

a device for placing a cap on each container;

a device for sealing the caps onto the containers; and a device for rejecting certain containers and for discharging the other containers from the system;

wherein the system comprises several modular units, each having a separate housing and a transport mechanism, wherein the housings of the modular units are connected to each other in series in such a way that the system is designed as an integral system, and wherein the transport mechanisms of the modular units are connected to each other in series, which ensures a positive guidance of each individual container by itself through the entire system;

wherein at least one modular unit comprises a transport mechanism for positively guiding the movement of each container by itself from a continuous screw movement to a clocked movement, wherein at least the device for dosing the pharmaceutical products and for introducing the pharmaceutical products into the containers comprises a transport mechanism for positively guiding the movement of each container by itself in a clocked manner; and wherein at least one modular unit comprises a transport mechanism for positively guiding the movement of each container by itself from a clocked movement to a continuous movement;

the connection of the transport mechanisms of adjacent modular units being achieved by a first screw conveyor arranged in an outlet portion of a first housing and by a second screw conveyor arranged in an inlet portion of a second housing, wherein a portion of the second screw conveyor is arranged parallel to and a predetermined distance away from a portion of the first screw conveyor, so that the parallel portions of the first and the second screw conveyors form a means for transferring and handing off the containers between the adjacent modular units.

* * * * *